United States Patent [19]

Goodman

[11] Patent Number: 4,809,905

[45] Date of Patent: Mar. 7, 1989

[54] MULTI-LAYER ENVELOPE DEVICE HAVING DETACHABLE ADHESIVE ADDRESS LABELS

[76] Inventor: Sidney R. Goodman, 5819 Caminito-Del-Esio, La Jolla, Calif. 92037

[21] Appl. No.: 5,702

[22] Filed: Jan. 22, 1987

[51] Int. Cl.[4] ..... B65D 27/00

[52] U.S. Cl. ..... 229/70; 229/73; 229/92.1; 428/42

[58] Field of Search ..... 229/73, 92.1, 70, 68 R; 206/447, 813, 820; 428/42, 352

[56] References Cited

U.S. PATENT DOCUMENTS

| | | | |
|---|---|---|---|
| 861,747 | 7/1907 | Mitchell | 229/92.1 |
| 967,406 | 8/1910 | Martin | 229/92.1 |
| 2,279,164 | 4/1942 | Gettleman | 229/92.1 |
| 2,391,539 | 12/1945 | Avery | 428/42 |
| 2,679,928 | 6/1954 | Bishop, Jr. et al. | 206/447 |
| 3,380,648 | 4/1968 | De Lyra | 229/73 |
| 3,466,217 | 9/1969 | Mott | 206/813 |
| 3,481,460 | 12/1969 | Watts | 206/447 |
| 3,545,669 | 12/1970 | Kinkade et al. | 229/73 |
| 3,706,626 | 12/1972 | Smith et al. | 428/42 |
| 3,896,246 | 7/1975 | Brady, Jr. | 206/447 |
| 4,244,125 | 1/1981 | Corey | 428/352 |

*Primary Examiner*—Stephen P. Garbe

*Attorney, Agent, or Firm*—Watts, Hoffmann, Fisher & Heinke Co.

[57] ABSTRACT

An envelope device having a multi-layer construction including an inner layer carrying a plurality of detachable, adhesive address label elements and an outer layer including at least one re-order portion with the inner and outer layers being adapted to receive variable informational indicia simultaneously printable by duplex processing.

8 Claims, 4 Drawing Sheets

MULTI-LAYER ENVELOPE DEVICE HAVING DETACHABLE ADHESIVE ADDRESS LABELS

DESCRIPTION

1. Technical Field

The present invention relates generally to envelopes and more particularly relates to a new and improved envelope device having a multi-layer construction including an inner layer carrying a plurality of detachable, adhesive address label elements and an outer layer including at least one re-order portion with the inner and outer layers adapted to receive variable information indicia simultaneously printable by duplex processing.

2. Background Art

Because of the greatly expanded volume of mail processed currently, and the attendant need for improving such mail order procedures, there is a need for an envelope type device which is applicable to commercial and non-commercial envelopes alike and which provides a higher standard of convenience and efficiency than is now available. Such mailing procedures typically include processing where re-orders for adhesive address labels are especially high such as in charitable and contribution functions including those, for example, involved with educational and religious institutions, political campaigns and various other types of fund raising activities. Heretofore, it has been typical in such cases to provide envelopes by printing, die cutting, address-plate impressions, collating, folding and stuffing into such envelopes. More recently, it has been known to provide a packet of envelopes, especially church-collection envelopes, formed from a continuous sheet for computer printing and scanning by standard type printing and scanning equipment. Such type of envelope is disclosed, for example, in U. S. Pat. No. 3,869,080. It has been recognized, however, that such prior envelopes and processes for making the same are not entirely satisfactory to the user for reducing paper costs by printing on both sides of the paper. Also, such prior envelope products do not offer the potential for general savings for computer generated material especially where it is required to automatically print the variable indicia on both sides of a page in a single pass, thus insuring, for example, that the address of the mailee and the re-order form on the opposite side correspond to the adhesive address label elements to be sent to the mailee. Accordingly, the present invention provides an envelope device which can be produced competitively on state-of-the-art automatic printing equipment without the need for modification of the equipment. Accordingly, the present invention provides an envelope device which is constructed and arranged to lend itself especially to printing by standard duplex operations on printing equipment available, such as the Xerox 8700 or 9700 Electronic Printing System with the duplex option.

DISCLOSURE OF THE INVENTION

The present invention relates generally to envelope products and more particularly relates to a new and improved envelope device with the improvement residing in a multi-layer construction including an inner layer carrying a plurality of detachable, adhesive address label elements and an outer layer with a self-addressed re-order portion and being adapted to be folded over into a single envelope construction. The device comprising such inner and outer layer of paper material is bonded together by an adhesive material, the outer layer including at least one foldable indicia receiving sections one of which includes the re-order portion, the inner layer being adhesively bonded to the outer layer and including a plurality of adhesive carrying address label elements detachably secured to the confronting surface of the outer layer, and the inner and outer layers both having perforated lines to provide weakened areas to enable the outer layer to be folded over the inner layer in the folded and mailing condition of the envelope device. The inner and outer layers both include the perforation lines to provide the foldability into the envelope device with the inner layer being provided with horizontal and vertical tear lines to provide a rectangular grid pattern defining a plurality of the adhesive return-address label elements which can be individually and selectively detached during normal uses thereof. In the invention, the inner and outer layers, with individual informational receiving sections, are adapted to receive variable printed indicia simultaneously, by duplex printing, such that the printing can be accomplished simultaneously on both sides in a single pass, thereby insuring that the address of the mailee and re-order portion on the outer layer correspond to the indicia printed on the labels carried by the inner layer.

The above and other advantages and objects of the present invention will become more apparent as the following description proceeds when taken in conjunction with the accompanying drawings.

BEST MODE FOR CARRYING OUT THE INVENTION

Figure 1:
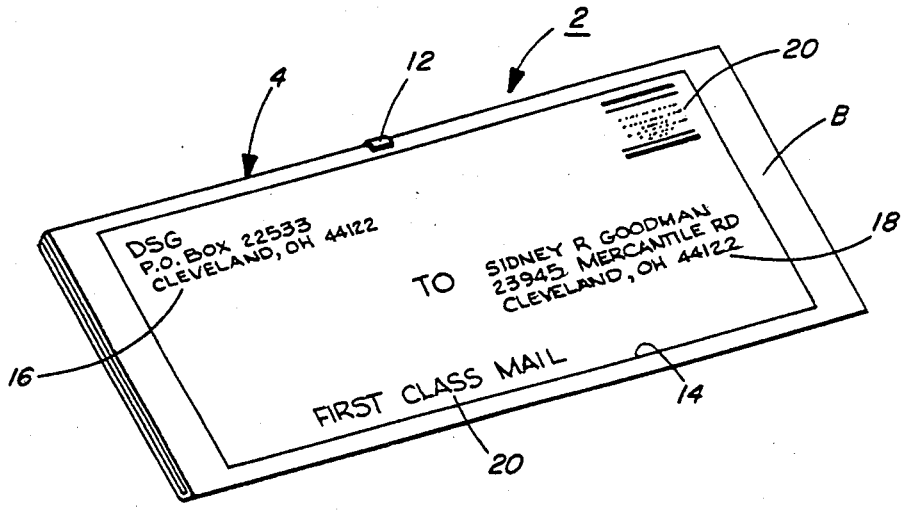
FIG. 1 is a generally perspective view illustrating the return envelope device made in accordance with the present invention.

Referring now again to the drawings and particularly to FIG. 1 thereof, there is illustrated the return-envelope device, designated generally at 2, of the invention in which, for purposes of illustration, is shown in the fully closed or flatly folded condition ready for mailing. The envelope device 2 includes a generally elongated polygonal (i.e. rectangular) body 4 conforming in size to postal regulations, especially in the United States. For example, prior to being folded into the configuration illustrated in FIG. 1, the body may have a size of $8\frac{1}{2}\times 11$ inches with the top and bottom sections being approximately $8\frac{1}{2}\times 3\ 21/32$ inches with the center section being approximately 3 11/16 inches. It will be understood, however, that the various dimensional relationships of the component parts can vary so long as the envelope device comports with applicable postal regulations.

Figure 2:
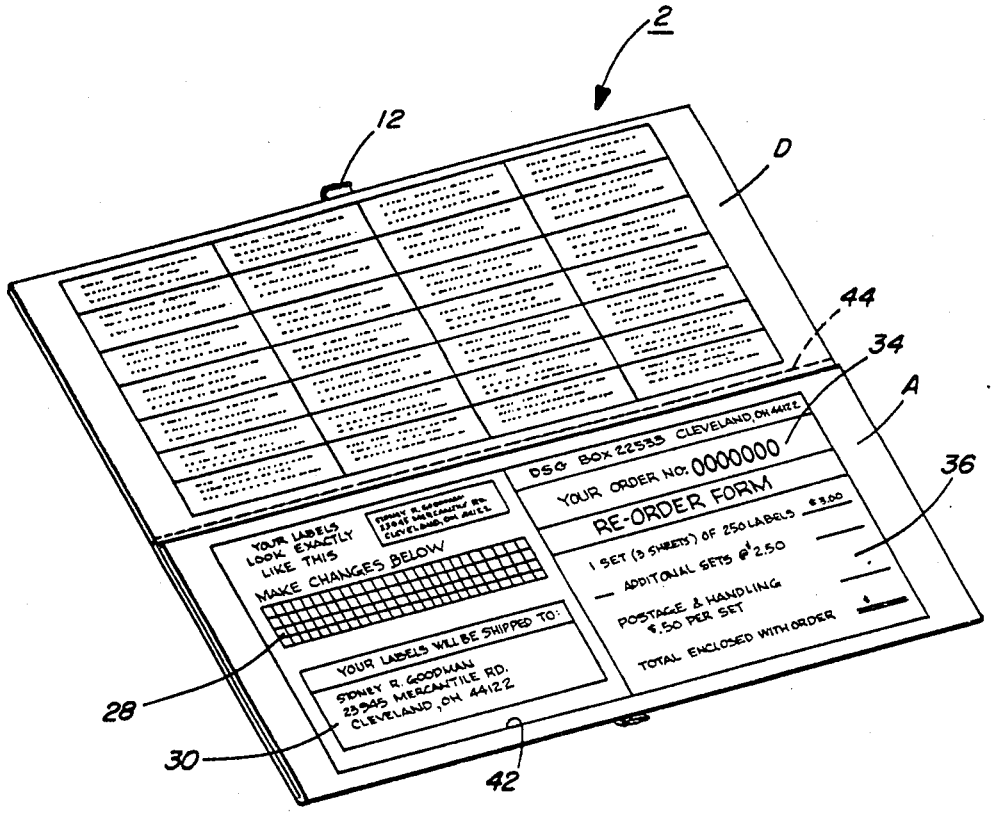
FIG. 2 is a generally perspective view illustrating a partially open condition of the return envelope illustrated in FIG. 1.
Figure 3:
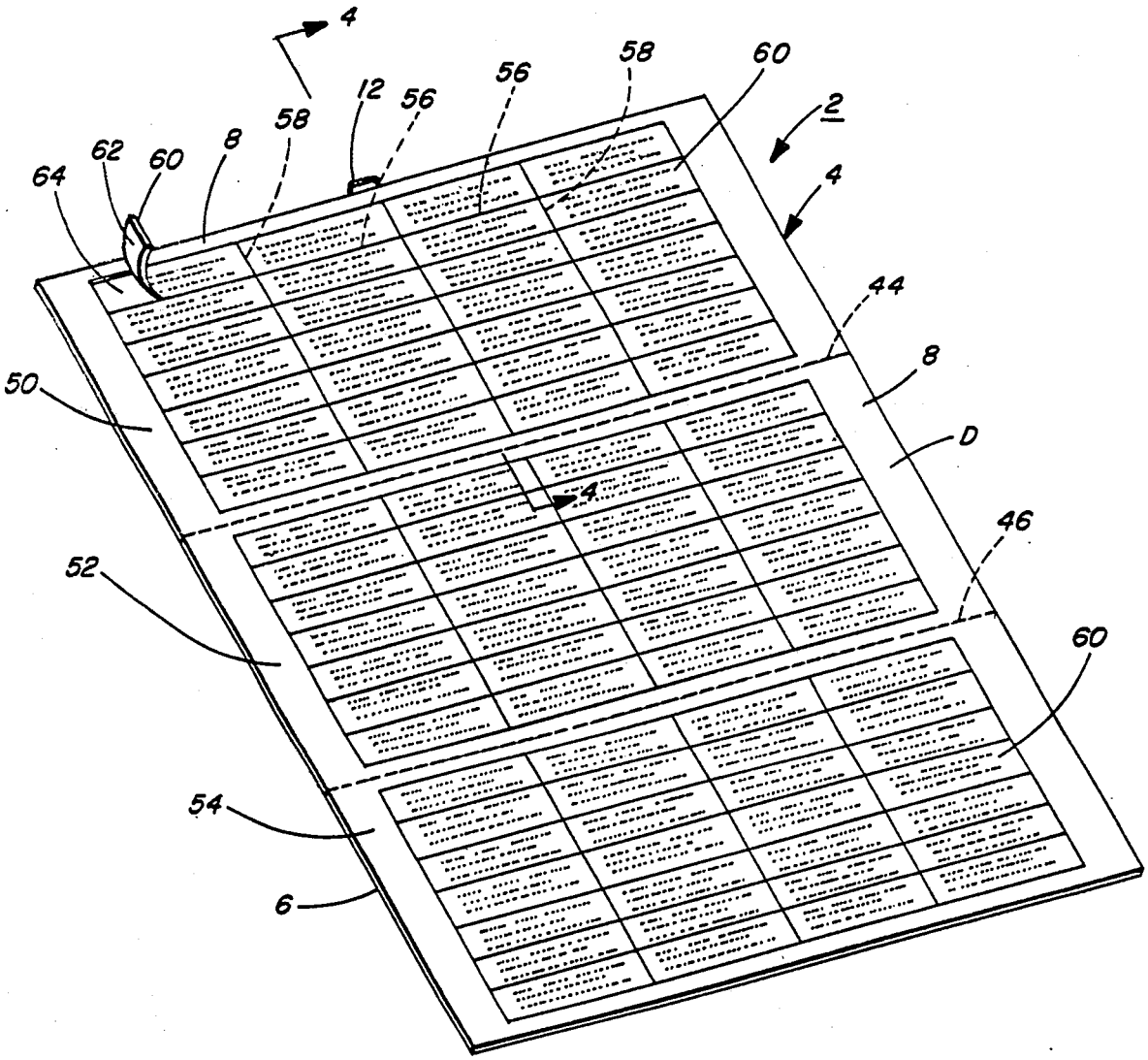
FIG. 3 is a generally perspective view illustrating the fully unfolded or open condition of the return envelope illustrated in FIG. 1 and showing the inner face layer containing a plurality of detachable adhesive address labels which may contain return-address indicia.
Figure 4:
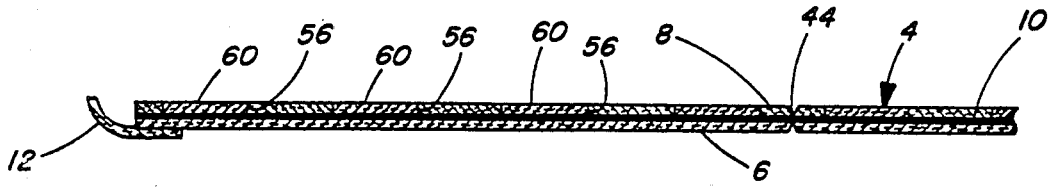
FIG. 4 is a fragmentary, vertical section view, on an enlarged scale, taken along the line 4—4 of FIG. 3.
Figure 5:
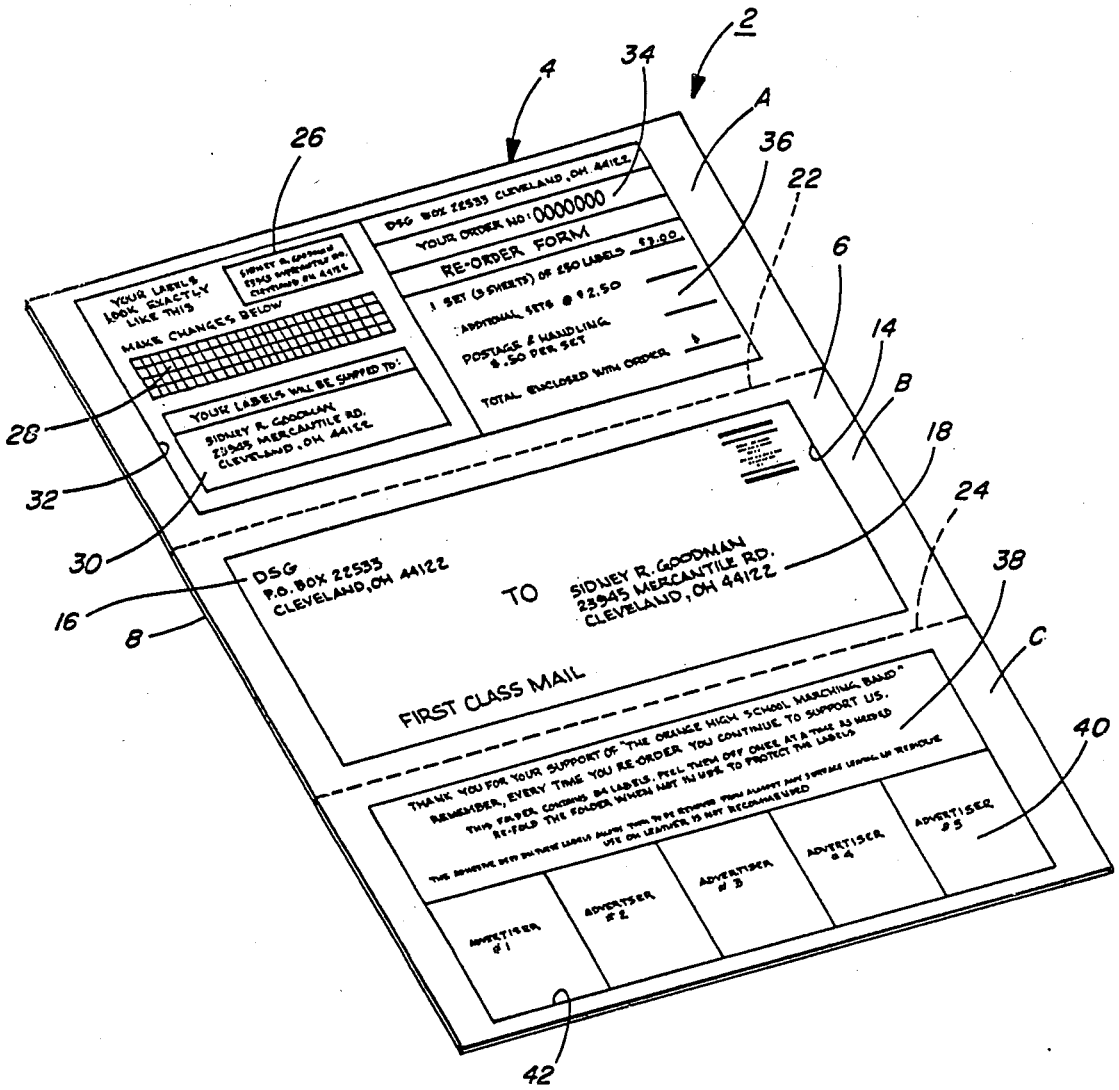
FIG. 5 is a generally perspective view illustrating the fully unfolded or open condition of the return envelope illustrated in FIG. 1, and showing the side opposite to that illustrated in FIG. 3.

In the embodiment illustrated, the body 4 is made of a laminated multi-layer construction (FIG. 4) including an outer layer 6 joined to an inner layer 8 by means of an adhesive bond material 10. The outer layer 6 may include an integral flap, as at 12, or a staple for securing the envelope device in the fully folded condition, as illustrated in FIG. 1. In the fully folded condition, therefore, the envelope product will be seen to have an open-ended construction with the body 4 folded so as to provide, in effect, a six-layer construction. It will be seen that the envelope product then incorporates the three separate information carrying sections, namely, a top section A, an intermediate section B, and a lower section C, as best illustrated in FIG. 5. On the opposite side, there is provided an adhesive label carrying section, as at D, which comprises the inner layer 8, as best illustrated in FIGS. 3 and 4. Accordingly, it will be seen that FIG. 3 represents the completely open condition of the adhesive label carrying section D, whereas, FIG. 5 illustrates the opposite side thereof with FIG. 2 illustrating an intermediate folded condition. Section A is folded approximately ⅓ of the body length onto approximately ⅓ of the exposed label carrying section D such that in the fully folded condition, illustrated in FIG. 1, section C will be folded over section A such that section D would comprise the front side of the return envelope and section C the rear side thereof.

Referring now again to FIG. 1, the intermediate section B may be provided with an inner line border 14 which confines the indicia within a predetermined margin. As shown, in the upper left-hand corner there is provided an area suitable for having printed thereon a sender or mailer address, as at 16, and in a lower rightward location an address area, as at 18, suitable for having printed thereon a receiver or mailee address. The upper right-hand corner may be provided with a suitable area, as at 20, for postage (i.e. First Class mail, etc.). If desired, the First Class mail indicia may be highlighted toward the lower left-hand corner thereof, as at 20. The intermediate section B is separated from the upper A and lower C sections by suitable perforated lines, as at 22 and 24, which are lines of weakening to enable the sections to be readily folded along these margins to provide the envelope device illustrated in FIG. 1. As best illustrated in FIG. 5, section A provides a re-order form which can be separately detached along the perforation line 22 or any number of additional sheets of return-address labels. This re-order form section A generally includes a label change order section and a monetary computation section. The label change section provides a suitable space area, as at 26, in the upper left-hand corner adapted to receive the return-address. A grid-work area, as at 28 is adapted to receive, in the box-like spaces, alphabetical letters to reflect any change to be made on the re-order return-address labels of the mailee. Below this is provided a mailee designation to ensure that the re-order return-address labels are correctly mailed to the mailee. Here again, this re-order form section A may be provided with a suitable interior line margin, as at 32, to ensure that the printed indicia is confined within the margins. The monetary computation section provides a suitable area, as at 34, for the customers (i.e. mailees) order number at the upper right-hand corner thereof, and therebelow, as at 36, the printed information as to the number of sets of sheets of labels to be re-ordered with the re-order price plus postage and handling indicated thereon. In the invention, it will be seen that one set, for example, may include three sheets of 252 labels. This will vary, however, dependent upon the size, both as to height and width of the labels desired so as to be accommodated within the area of the label carrying section D. In the form shown, the labels are approximately 1.875 inches wide by approximately 15/32 of an inch in depth.

The lower section C contains, as at 38, suitable informational indicia which may relate, for example, to the charitable cause and directions for use of the envelope device in relation to the transmitted return address labels. Also, the lower horizontal portion 40 of this section may be provided with suitable individual spaces (i.e. designated advertiser 1–5) for receiving advertising and/or store coupons. This area could be sold as advertising to contributing merchants to increase the level of the fund-raising activity. This section can also incorporate the interior line margin, as at 42, which corresponds in size to the line margin 32 in section A and to line margin 14 in section B.

As best illustrated in FIG. 3, the adhesive layer carrying section D, includes a unitary, one-piece layer of paper material 8 which is adhesively bonded, as at 10, to the outer paper layer 6. This layer 8 is provided with two tear lines, as at 44 and 46, which divide this section into three generally equal size portions. As shown, each portion comprises a panel which is perforated in a rectangular grid pattern to provide horizontal tear lines 56 and vertical tear lines 58 which together produce a plurality of detachable, adhesive return-address labels 60. In the embodiment illustrated, for example, each portion may include 84 labels with each label including an adhesive material, as at 62, on the back side thereof which enables the individual labels to be temporarily adhered to the back side of the outer paper layer 6, as at 64. This allows the label to be re-applied by the mailee to another envelope for conventional mailing purposes, as desired. Accordingly, the individual labels can be peeled off, one-at-a-time as needed. In such case, the envelope device can be re-folded to the condition illustrated in FIG. 1 to protect the remaining labels during non-use thereof. To use the labels, it is preferred that the user start in the upper left-hand corner and then move from the left to right, as illustrated in FIG. 3.

The return envelope device of the present invention is constructed and arranged in a configuration especially adapted for printing on a standard computer such as the Xerox 8700 or 9700 Electronic Printing System. In such system, duplex printing is accomplished where the product to be processed is printed on both sides simultaneously. Accordingly, in the present invention the envelope device is configured such that the variable data on both sides of the envelope (i.e. unfolded condition) are automatically printed in a single pass, thereby ensuring that the address on the re-order form of Section A corresponds indentically to the addresses incorporated on the adhesive labels carried on the reverse side of section D. Accordingly, by this arrangement, the configuration of the return envelope device provides a self-contained number of return-address labels which can be accurately printed and re-ordered for substantial economic savings and mailing costs for computer-generated materials.

Figure 6:
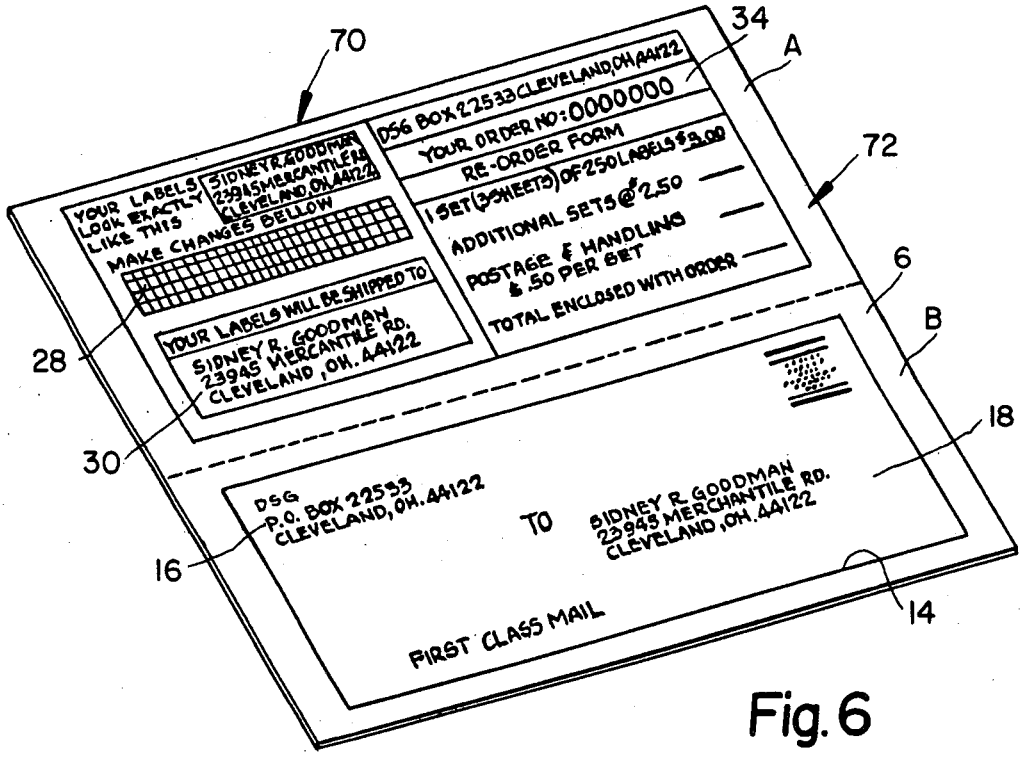
FIG. 6 is a generally perspective view of the envelope in a modified form.
Figure 7:
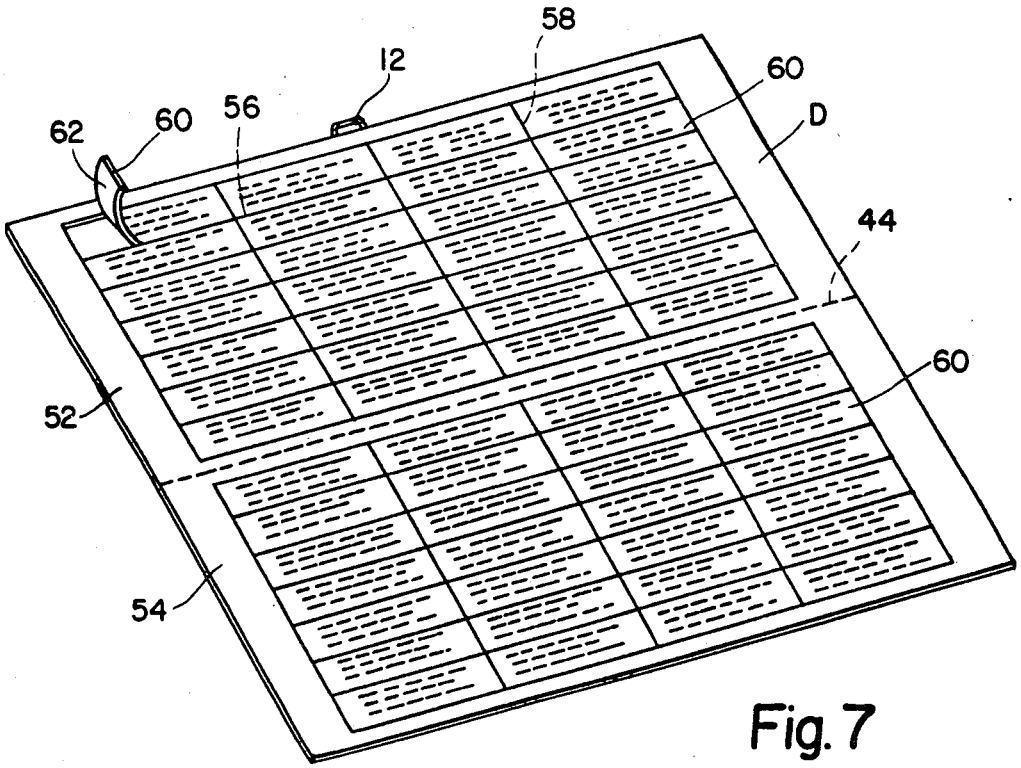
FIG. 7 shows the envelope of FIG. 6 in the open condition.

In FIGS. 6 and 7 there is illustrated a modified form of the envelope device, designated generally at 70, of the invention wherein like reference numerals refer to like parts throughout. In this form, the body 72 is of a laminated multi-layer construction, as with FIG. 4, but in this form the envelope includes the top section A and only the intermediate or now lower section B. Here again, on the opposite side there is provided the adhesive label carrying section, as at D, which comprises the inner layer 8, as best illustrated in FIGS. 3 and 4. Accordingly, FIG. 7 represents the open condition of the adhesive label carrying section D, whereas, FIG. 6 represents the unfolded condition of the opposite side such that the envelope would be folded twice rather than three times as illustrated in FIG. 1. In other words, the information contained on the lower section C of FIG. 5 has been omitted such that the envelope can be folded into two superimposed layers, as distinguished from three superimposed layers.

Further advantages and objects of the present invention will become apparent when taken in conjunction with the following claims.

I claim:

1. An envelope device with the improvement being a multi-layer construction carrying a plurality of detachable, adhesive carrying return address label elements and a self-address re-order portion, said device comprising an inner and outer layer of paper material bonded together in superimposed relationship by an adhesive bonding material, said outer layer having more than one foldable indicia receiving section one of which includes said self-address re-order portion, said inner layer being adhesively bonded to said outer layer and including said plurality of adhesive carrying return-address label elements detachably secured to the confronting surface of said outer layer, and said inner and outer layers having perforated lines to provide weakened areas to enable said indicia receiving sections to be folded over in the folded mailing condition of said envelope device.

2. An envelope device in accordance with claim 1, wherein said envelope device, in the folded condition, has at least three foldable indicia receiving sections.

3. An envelope device in accordance with claim 2, wherein said envelope device is foldable into said sections along two horizontal perforated lines, with said inner layer being comprised of a grid construction defining said plurality of detachable, adhesive carrying label elements having address indicia printed thereon and adapted to be removed therefrom for adhesive securement to a different envelope device.

4. An envelope device in accordance with claim 1 wherein said outer layer includes said re-order portion detachably connected by a perforation line upon depletion of the label elements carried by said inner layer and adapted for re-order of additional of said label elements.

5. An envelope device in accordance with claim 1, wherein said inner and outer layers each include printed indicia adapted to be applied simultaneously thereto by automatic duplex printing.

6. An envelope device in accordance with claim 1, wherein said inner and outer layers together define a body which is perforated through both layers along horizontal lines to form said multiple sections on said inner and outer layers including said re-order portion.

7. An envelope device in accordance with claim 6, wherein said inner layer is further perforated by tear lines including horizontal and vertical rows to provide a grid pattern defining said detachable labels, each of said labels being adhesively secured in back-to-back relation with the confronting surface of said outer layer.

8. An envelope device in accordance with claim 1, wherein said outer layer includes an intermediate section disposed between upper and lower sections, said intermediate section having a first area adapted for receiving mailee address indicia, and a second area adapted to receive mail or address indicia.

* * * * *